US007446483B2

(12) United States Patent
Nishinosono

(10) Patent No.: US 7,446,483 B2
(45) Date of Patent: Nov. 4, 2008

(54) BACKLIGHT LIGHT SOURCE DRIVE DEVICE

(75) Inventor: Kazuo Nishinosono, Daito (JP)

(73) Assignee: Funai Electric Co., Ltd., Osaka (JP)

( * ) Notice: Subject to any disclaimer, the term of this patent is extended or adjusted under 35 U.S.C. 154(b) by 77 days.

(21) Appl. No.: 11/527,398

(22) Filed: Sep. 27, 2006

(65) Prior Publication Data

US 2007/0075653 A1 Apr. 5, 2007

(30) Foreign Application Priority Data

Sep. 30, 2005 (JP) ..... 2005-288939

(51) Int. Cl.
*H05B 41/24* (2006.01)

(52) U.S. Cl. ..... 315/247; 315/291; 315/246; 315/307; 315/224

(58) Field of Classification Search ..... 315/169.3, 315/209 R

See application file for complete search history.

(56) References Cited

U.S. PATENT DOCUMENTS 6,492,780 B1 * 12/2002 Sheu et al. ..... 315/219
2005/0017647 A1 * 1/2005 Huang ..... 315/119
2006/0220595 A1 * 10/2006 Lu ..... 315/291

FOREIGN PATENT DOCUMENTS

| | | |
|---|---|---|
| JP | 05-142539 | 6/1993 |
| JP | 11-355960 | 12/1999 |
| JP | 2002-134293 | 5/2002 |

* cited by examiner

*Primary Examiner*—Tuyet Vo
*Assistant Examiner*—Jae K Kim
(74) *Attorney, Agent, or Firm*—Pillsbury Winthrop Shaw Pittman LLP

(57) ABSTRACT

This backlight light source drive device includes a plurality of backlight light source drive circuits which drive a plurality of respective backlight light sources, and a control circuit which turns those drive circuits ON and OFF. Each of the drive circuits includes a protection signal output circuit which, when its corresponding tube electrical current decreases, outputs to the control unit a protection signal for stopping the operation of all of the drive circuits. This protection signal output circuit includes an LED illumination circuit which, when the tube electrical current thus decreases, illuminates an LED to indicate the anomalous state, and an LED power supply circuit which always supplies power to the LED illumination circuit. And the control circuit stops the operation of all of the plurality of backlight light source drive circuits, when it receives a protection signal from any one or more of the protection signal output circuits.

2 Claims, 2 Drawing Sheets

BACKLIGHT LIGHT SOURCE DRIVE DEVICE

CROSS REFERENCE

This Nonprovisional application claims priority under 35 U.S.C. § 119(a) on Patent Application No. 2005-288939 filed in Japan on Sep. 30, 2005, the entire contents of which are hereby incorporated by reference.

BACKGROUND OF THE INVENTION

The present invention relates to a backlight light source drive device which is placed upon the rear surface of a display panel such as a liquid crystal display panel or the like.

Normally, a plurality of backlight light sources of this type are provided. For example, with a display panel for a liquid crystal television of the 30 to 40 inch screen size class, ten to fourteen backlight light sources are provided. Furthermore, for such a light source, often a cold cathode tube (a Cold Cathode Fluorescent Lamp) is employed (hereinafter this will simply be termed a CCFL), and a high voltage of 1 to 2 kV is applied between the electrodes at both ends thereof.

On the other hand, since a high voltage from the secondary side of a transformer is applied to such a CCFL, if a circuit anomaly such as the CCFL becoming unserviceable or its connector coming off or the like occurs, then the transformer secondary side goes into the no load state and the transformer output voltage is anomalously elevated. Accordingly, if this state is not recovered from, there is a possibility that, due to this anomalous elevation of the secondary side voltage, burn-out or the like of some component may occur. Thus, in a backlight light source drive device according to the prior art, there is provided a protection signal output circuit which, when the electrical current in any single tube of the backlight light source drops below a threshold value, outputs a protection signal to a control unit for completely stopping the entire operation of the backlight light source drive circuit. When this protection signal is outputted to the control unit, in the interests of safety, a control circuit stops the operation of all of the drive circuits which are respectively provided to all of the backlight light sources. In concrete terms, the drive power supply is cut off in order to stop oscillation operation (refer to Japanese Laid-Open Patent Publication 2002-134293 and Japanese Laid-Open Patent Publication H11-355960).

Furthermore, a device has been proposed (in Japanese Laid-Open Patent Publication H05-142539) in which the end of life of a CCFL is detected by decrease of the corresponding tube electrical current, and an LED is turned ON when it has thus been detected that a CCFL has come to the end of its life.

However, with the devices of the above described Japanese Laid-Open Patent Publication 2002-134293 and Japanese Laid-Open Patent Publication H11-355960, since the oscillation is stopped immediately an anomaly occurs, accordingly, with a device which employs a plurality of backlight light sources, and in which moreover backlight light source drive circuits are connected to these backlight light sources, it cannot simply be understood which of the backlight light sources or drive circuits is the faulty one. The reason why is that, with the drive circuit whose oscillation has stopped and which is accordingly in the operation stopped state, the backlight light source or drive circuit in which the anomaly has occurred appears the same as a normal backlight light source or drive circuit, both in outward appearance and in terms of electrical signals.

Furthermore, with the device of the above described Japanese Laid-Open Patent Publication H05-142539, it is arranged, when the end of life of a tube is detected by decrease of its tube electrical current, to display this condition upon a display LED. Due to this, if this device is employed in a device which uses a plurality of backlight light sources, and in which, moreover, backlight light source drive circuits are connected to these backlight light sources, then, when an anomaly occurs, it is possible to determine upon which of the backlight light sources or drive circuits the fault has occurred, by seeing whether or not the LEDs are illuminated.

However, with this device disclosed in this Japanese Laid-Open Patent Publication H05-142539, since there is not provided any protection signal output circuit for outputting a protection signal for stopping the operation of all of the drive circuits, even if an anomaly occurs, the operation of the drive circuits is continued. Furthermore, even if hypothetically this type of protection signal output circuit were to be provided, when the input power supply went OFF, the LEDs would be extinguished. In any case, with the device disclosed in this Japanese Laid-Open Patent Publication H05-142539, even if a protection signal output circuit is provided, it still is not possible to decide in which of the backlight light sources or drive circuits the fault may be present, just as in the case of the above described Japanese Laid-Open Patent Publication 2002-134293 or Japanese Laid-Open Patent Publication H11-355960.

Thus, with a backlight light source drive device according to the prior art, although a circuit for detecting decrease of tube electrical current is provided, since no protection signal output circuit has been provided; or, even if a protection signal output circuit has been provided, there has been the shortcoming that it has not been possible to decide in which of the backlight light sources or drive circuits a fault is present.

A feature of the present invention is to provide a backlight light source drive device, which makes it possible, when a fault has occurred in a backlight light source, or a connector has come loose, or a circuit fault or the like has occurred, directly to confirm visually the position of this backlight light source, and the position of the drive circuit which drives this backlight light source.

Another feature of the present invention is to provide a backlight light source drive device, with which repairs can be performed safely, and moreover with which a fault does not become aggravated during repair due to burnout of a component or the like.

SUMMARY OF THE INVENTION

The backlight light source drive device of the present invention is a backlight light source drive device which drives a plurality of backlight light sources disposed at the rear surface of a liquid crystal panel.

And this backlight light source drive device includes a plurality of backlight light source drive circuits which respectively drive the plurality of backlight light sources, and a control circuit which turns the plurality of backlight light source drive circuits ON and OFF.

Each of the plurality of backlight light source drive circuits includes a tube electrical current detection circuit which detects the tube electrical current of the corresponding backlight light source, and a protection signal output circuit which includes: an LED illumination circuit which, when the tube electrical current detected by the tube electrical current detection circuit becomes less than or equal to a fixed threshold value, along with illuminating an LED which indicates an anomalous condition, also outputs to the control circuit a protection signal for stopping the operation of all of the plurality of backlight light source drive circuits; and an LED power supply circuit which supplies power to the LED illumination circuit, irrespective of whether the backlight light source drive circuits are turned ON or OFF by the control circuit.

Furthermore, the control circuit turns all of the plurality of backlight light source drive circuits OFF, upon receipt of a protection signal from any one of the protection signal output circuits of the plurality of backlight light source drive circuits.

A plurality of units are provided, each of them including one backlight light source drive circuit and one backlight light source. One control circuit is connected to these units, and, when a protection signal is outputted to the control circuit from any one of the protection signal output circuits, the control circuit outputs an OFF signal to all of the units, so as to stop the operation of all of the backlight light source drive circuits. Due to this, the secondary side of the transformer no longer provides any output, since the oscillation circuit which is connected to the primary side of the transformer goes into the non-oscillating state.

The LED illumination circuit illuminates the LED when the tube electrical current decreases to less than or equal to the fixed threshold value. At the same time, a protection signal is outputted to the control circuit. At this time, the LED power supply circuit supplies operating power to the LED illumination circuit, irrespective of the ON/OFF control state of the backlight light source drive circuit. Due to this, the illumination of the LED is maintained even if the supply of drive power to the drive circuit is stopped. When this arrangement is implemented, it becomes possible directly to visually confirm in which unit of the plurality of units the fault is present, in other words, in which of the backlight light sources or in which of the backlight light source drive circuits the fault is present. It should be understood that, when maintaining the illumination of the LED, there is no danger during the repair process, since no voltage is being generated at the secondary side of the transformer; and, moreover, there is also no possibility of damage to any component.

Each of the protection signal output circuits may include a thyristor which is connected in series with the LED, and which outputs the protection signal by being turned ON, and a Zener diode which is connected to the gate terminal of the thyristor, and which is turned ON when the tube electrical current detected by the corresponding tube electrical current detection circuit becomes less than or equal to a fixed threshold value. Since the thyristor is turned ON when the tube electrical current temporarily decreases below the fixed threshold value, accordingly henceforward the LED which is connected in series with this thyristor is kept illuminated.

DETAILED DESCRIPTION OF THE INVENTION

Figure 1:
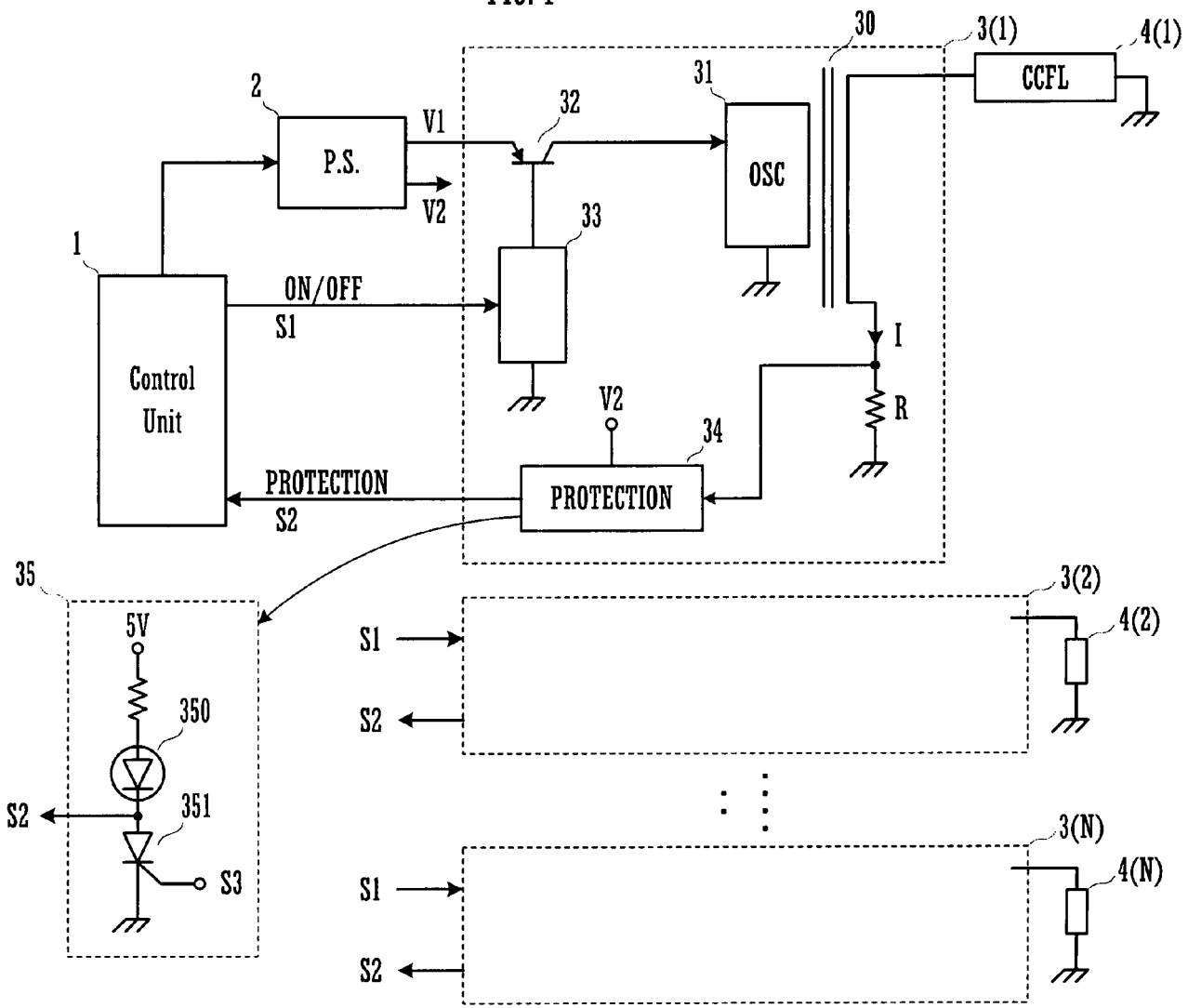
FIG. 1 is a conceptual block diagram of a backlight light source device which is an embodiment of the present invention.

FIG. 1 is a conceptual block diagram of a backlight light source device for a liquid crystal display panel, which is an embodiment of the present invention.

A power supply circuit 2 which is connected to a control unit 1 provides supply V1 of drive power to a plurality of backlight light source drive circuits 3 (3(1), 3(2), . . . 3(N)), and moreover provides supply V2 of drive power to an LED illumination circuit which will be described hereinafter. Backlight light sources 4 (4(1), 4(2), . . . 4(N)) which are connected to the backlight light source drive circuits 3 are positioned upon the rear surface of a single liquid crystal display panel, as is per se well known; each of these backlight light source drive circuits 3 has the same structure. In the following, one of these backlight light source drive circuits 3(1) and the corresponding one of the backlight light sources 4(1) which is connected to it will be explained.

The backlight light source drive circuit 3(1) comprises: a transformer 30, to the secondary side winding of which is connected the backlight light source 4(1); an oscillation circuit 31 which is connected to the primary side winding of this transformer 30, and which performs self-excited oscillation; a switching element 32 which supplies the drive power supply V1 generated by the power supply circuit 2 to the oscillation circuit 31; a switching element control unit 33 which turns the switching element 33 ON and OFF according to a drive circuit ON/OFF signal S1 (hereinafter simply termed the signal S1) from the control unit 1; a shunt resistor R (a tube electrical current detection circuit) which is connected in series with the tube electrical current circuit and which detects the tube electrical current I; and a protection signal output circuit 34, to which the voltages at both ends of the shunt resistor R are inputted, and which outputs to the control unit 1 a PROTECTION signal S2 (hereinafter simply termed the signal S2) for stopping the operation of all of the backlight light source drive circuits 3 (3(1), 3(2), . . . 3(N)) when the tube electrical current I decreases.

The power supply V2 from the power supply circuit 2 is supplied to this protection signal output circuit 34. This protection signal output circuit 34 comprises an LED illumination circuit 35 which comprises an LED 350 which is connected to the power supply V2 via an LED power supply circuit which will be described hereinafter, and a thyristor 351 which is connected to the anode side of this LED 350, and to the gate of which is inputted a gate ON signal S3 (hereinafter simply termed the signal S3). In this embodiment, this thyristor 351 in the LED illumination circuit 35 also serves as a protection signal output unit. The signal S3 is generated when the magnitude of the tube electrical current I which is detected by the shunt resistor R is less than or equal to a fixed threshold value. At this time, the thyristor 351 is turned ON, and the LED 350 is illuminated.

Next, the operation of this system will be explained.

When the power supply is turned ON, the power supply circuit 2 generates the power supply V1 and the power supply V2, and these are respectively supplied to the switching element 32 and to the protection signal output circuit 34. Furthermore, the control unit 1 supplies the signal S1 to the switching element control unit 33, and thereby the switching element 32 is turned ON. Due to this, the oscillation circuit 31 commences its oscillation operation, and a high voltage is generated at the secondary side of the transformer 30, so that the backlight light source 4(1) is illuminated.

When the backlight light source 4(1) is illuminated, the tube electrical current I is always detected by the shunt resistor R, and, if its magnitude is less than or equal to the fixed threshold value, the protection signal output circuit 34 generates the signal S2 and inputs it to the control unit 1. Upon receipt of this signal S2, the control unit 1 turns the signal S1 OFF. When this is done, since the switching element 32 also is turned OFF, the operation of the oscillation circuit 31 is stopped, and the voltage transformation operation of the transformer also ceases. In other words, the backlight light source 4(1) is extinguished.

When the above described signal S2 is generated by any one of the drive circuits 3, since the signal S1 from the control unit 1 is outputted to all of the drive circuits 3, in conclusion, all of the backlight light sources 4 are extinguished at the same time.

On the other hand, in the drive circuit which has generated the signal S2, the thyristor 351 is turned ON by the signal S3 being generated, so that the LED 350 is turned ON and is illuminated. Since, at this time, the power supply V2 is not interrupted but continues to be supplied via the LED power supply circuit which will be described hereinafter, accordingly the LED 350 is kept in the illuminated state, even if the signal S3 ceases to be outputted.

Accordingly, even though all of the backlight light sources 4 are extinguished, due to the fact that the illuminated state of this LED 350 can be visually confirmed, it is possible for a workman who is to perform a repair to know which of the backlight light sources 4 or the drive circuits 3 is the one which has become out of order in a simple and easy manner. It should be understood that, since the thyristor 351 is used in the LED illumination circuit 35, accordingly, the protection signal output circuit continues to operate and the LED 350 continues to be illuminated, even if the magnitude of the tube electrical current I has only decreased momentarily. Accordingly it is possible to detect failure, even with a backlight light source 4 in which decrease of the tube electrical current sometimes occurs near the end of its life, or with a drive circuit 3 in which, due to the connector intermittently becoming loose, the repeatability of decrease of the tube electrical current is poor.

Figure 2:
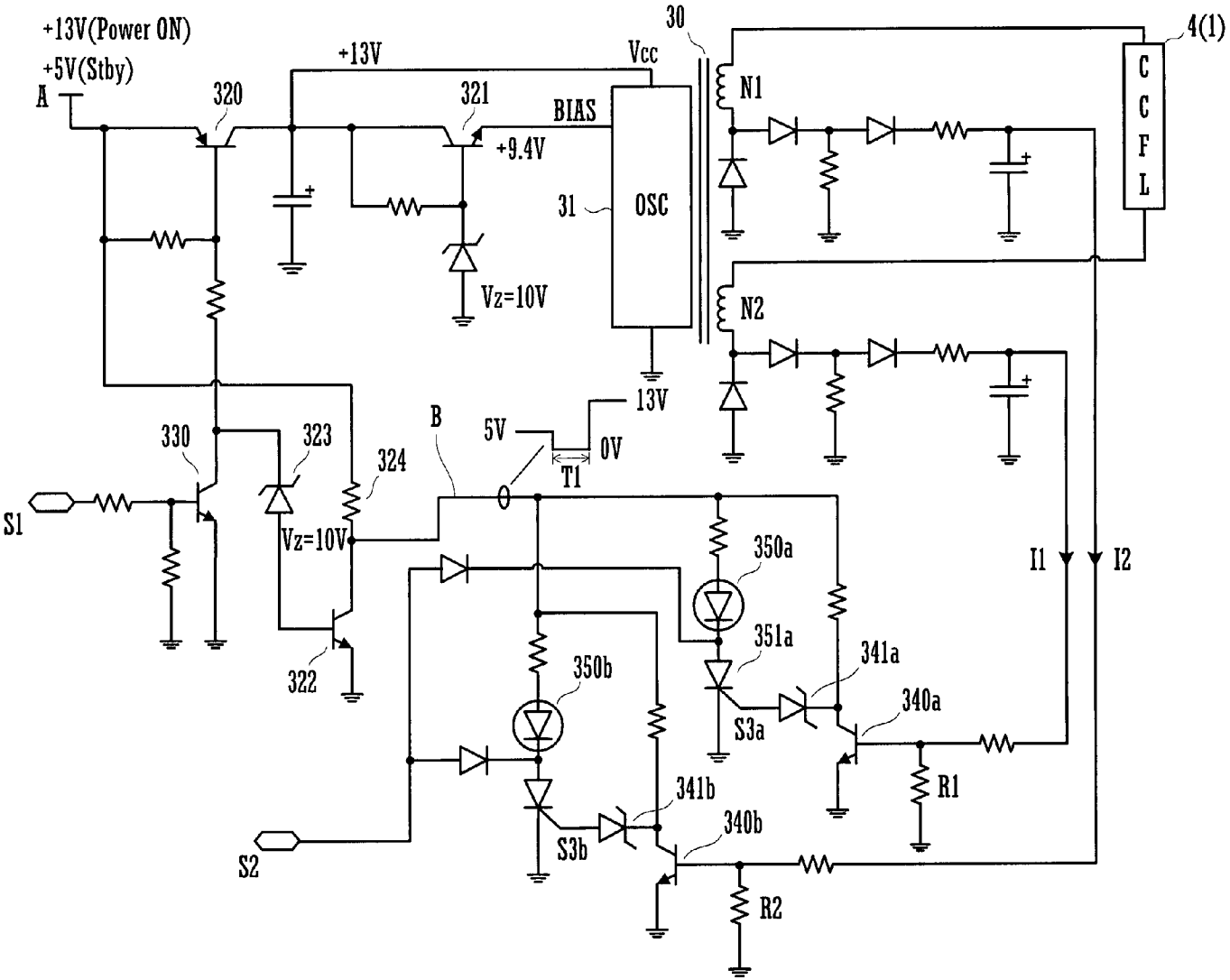
FIG. 2 is a circuit diagram of this backlight light source device which is an embodiment of the present invention.

FIG. 2 is a concrete example of a circuit diagram for the above described backlight light source drive circuit 3(1).

The secondary side winding of the transformer 30 comprises a winding N1 and a winding N2, and the output voltages of these windings N1 and N2 are set at 1000 V. The outputs of these windings N1 and N2 are supplied to the two end terminals of the backlight source 4(1), so that a voltage of 2000 V is applied between the two end terminals of the backlight source 4(1). Although a tube electrical current flows in alternating directions each half wave from the backlight light source 4(1) to the light source 4(1), shunt resistors R1 and R2 are provided in the backlight light source drive circuit 3(1) for respectively detecting the tube electrical currents I1 and I2 in the two directions, according to the directions of these tube electrical currents. These shunt resistors R1 and R2 correspond to the shunt resistor R in FIG. 1.

The protection signal output circuit 34 comprises a transistor 340*a* which is turned ON if the magnitude of the tube electrical current I1 detected by the shunt resistor R1 is greater than or equal to a threshold value, a Zener diode 341*a* which goes continuous and generates a signal S3*a* when this transistor 340*a* is OFF, and a thyristor 351*a*, to the gate of which the signal S3*a* is supplied, and to the anode side of which an LED 350*a* is connected.

According to the above structure, when the tube electrical current I1 exceeds the fixed threshold value, since the transistor 340*a* is turned ON, accordingly the Zener diode 341*a* is not continuous. Due to this the thyristor 351*a* remains OFF, since the signal S3*a* is not generated. On the other hand, if the tube electrical current is less than or equal to the fixed threshold value, then the transistor 340*a* transits to OFF. When this happens, the Zener diode 341*a* goes to continuous (turns ON), and, due to the generation of the signal S3*a*, the thyristor 351*a* is turned ON. At this time, the LED 350*a* is illuminated. Furthermore since, when the thyristor 351*a* turns ON, its anode terminal drops to ground level, accordingly the signal S2 is generated (becomes low). When this signal S2 is inputted to the control unit 1, the signal S1 is turned OFF by the control unit 1.

With the structure described above, the transistor 340*a*, the Zener diode 341*a*, and the thyristor 351*a* constitute a circuit for outputting the signal S2 (i.e. a protection signal output unit), while the LED 350*a* and the thyristor 351*a* correspond to the "LED illumination circuit" of the Claims.

In the same manner, with regard to the tube electrical current I2 of the opposite polarity, the resistor R2 is a shunt resistor which detects the tube electrical current I2, and the transistor 340*b*, the Zener diode 341*b*, and the thyristor 351*b* constitute a circuit for outputting the signal S2 (i.e. a protection signal output unit), while the LED 350*b* and the thyristor 351*b* correspond to the "LED illumination circuit" of the claims.

In the embodiment of FIG. 2, the drive power supply V1 which is outputted from the power supply circuit 2 is 13 V, while the power supply V2 which is outputted for supply to the LED illumination circuit is 5 V; and these are inputted to the same power supply input terminal A. In other words, when the power supply is ON, 13 V is inputted to the power supply input terminal A, while, when the signal S1 is OFF and the drive circuit goes into the operation stopped state (this state is termed the standby state), then 5 V is inputted. During the standby state, the power supply voltage which is inputted to this power supply input terminal A is supplied to the above described LED illumination circuit and to the above described protection signal output unit. Furthermore, the power supply which is supplied to the power supply input terminal A is inputted to the oscillation circuit 31 via a transistor 320 which corresponds to the switching element 32 (in FIG. 1), and 13 V is converted to a bias voltage of 9.4 V via a transistor 321 and is supplied to the oscillation circuit 31.

The signal S1 is inputted to the base of a transistor 330 which corresponds to the switching element control unit 33 (in FIG. 1), and the collector of this transistor 330 is connected to the base of a transistor 322 via a Zener diode 323. The collector of the transistor 322 is connected to the power supply line B of the LED illumination circuit. The LED power supply circuit of the present invention is constituted by the power supply line B and a resistor 324 which is connected in series with this line B.

With the above structure, when the power supply is turned ON, 13 V is supplied to the power supply input terminal A, and the signal S1 goes to ON after a fixed time period T1 has elapsed (refer to FIG. 2). At this time T1 after the power supply has been turned ON, since the transistor 330 is OFF and the transistor 322 is ON, accordingly the power supply line B is maintained at 0 V. Due to this, at this time T1, the LED illumination circuit and the protection signal output unit are reset.

When the period T1 has elapsed and the signal S1 goes to ON, the transistor 330 and the transistor 320 go to ON, and 13 V comes to be supplied to the oscillation circuit 31, so that illumination of the backlight light source is commenced. Furthermore, since the transistor 322 is OFF, the voltage on the power supply line B is near 13 V, and this voltage is supplied to the LED illumination circuit and to the protection signal output unit as drive power.

Thereafter, when a decrease of the tube electrical current I1 or I2 is detected, the LED 350*a* or 350B is illuminated, and moreover the signal S2 goes to low (i.e. the signal S2 is generated). When the signal S2 goes to low, the control unit goes into the standby state, and the voltage outputted at the power supply input terminal A changes from 13 V to 5 V, and moreover the signal S1 goes to OFF (falls to low). When this happens, the transistor 330 and the transistor 320 go to OFF, and the operation of the oscillation circuit 31 stops (i.e. the operation of the drive circuit stops).

In the above described standby state, 5 V is applied to the power supply line B (more precisely, there is a voltage drop due to the resistor 324), and this is supplied to the LED illumination circuit and to the protection signal output unit as drive power. Accordingly, due to the LED 350*a* or 350*b*, it is possible for the drop of the tube electrical current I1 or I2 to be known externally (for example, to repair personnel).

As described above, even in the standby state, it is easily possible to find which of the backlight light sources 4 is in an anomalous state, according to which of the LEDs is illuminated. In the same manner when, due to a connector coming off or due to a failure of the circuitry or the like, a tube electrical current has decreased, it is also possible to find the position thereof.

What is claimed is:

1. A backlight light source drive device which drives a plurality of backlight light sources disposed at the rear surface of a liquid crystal panel, the backlight light source drive device comprising:

a plurality of backlight light source drive circuits configured to respectively drive the plurality of backlight light sources, and a control circuit configured to turn the plurality of backlight light source drive circuits ON and OFF, each of the backlight light source drive circuits including:

a current detection circuit configured to detect a current through the individual backlight light source; and a protection signal output circuit which includes:

an LED illumination circuit which, when the current detected by the current detection circuit becomes less than or equal to a fixed threshold value, illuminates an LED which indicates an anomalous condition and outputs a protection signal to the control circuit for stopping the operation of all of the plurality of backlight light source drive circuits; and an LED power supply circuit which supplies power to the LED illumination circuit, irrespective of whether the backlight light source drive circuits are turned ON or OFF by the control circuit;

wherein the control circuit turns all of the plurality of backlight light source drive circuits OFF, upon receipt of a protection signal from any one of the protection signal output circuits of the backlight light source drive circuits, and wherein each of the protection signal output circuits comprises:

a thyristor, which is connected in series with the LED, and outputs the protection signal by being turned ON; and a Zener diode, which is connected to the gate terminal of the thyristor, and is turned ON when the electrical current detected by the corresponding electrical current detection circuit becomes less than or equal to a fixed threshold value.

2. The backlight light source drive device according to claim 1, wherein each of the current detection circuits comprises a resistor which is connected in series with the corresponding of the plurality of backlight light sources.

* * * * *